US011651945B2

(12) United States Patent
Kertesz et al.

(10) Patent No.: US 11,651,945 B2
(45) Date of Patent: May 16, 2023

(54) RAPID DROPLET INTRODUCTION INTERFACE (RDII) FOR MASS SPECTROMETRY

(71) Applicant: UT-Battelle, LLC, Oak Ridge, TN (US)

(72) Inventors: Vilmos Kertesz, Oak Ridge, TN (US); John F. Cahill, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 17/480,094

(22) Filed: Sep. 20, 2021

(65) Prior Publication Data

US 2022/0102127 A1 Mar. 31, 2022

Related U.S. Application Data

(60) Provisional application No. 63/083,202, filed on Sep. 25, 2020.

(51) Int. Cl.
*H01J 49/00* (2006.01)
*H01J 49/04* (2006.01)
(Continued)

(52) U.S. Cl.
CPC ..... *H01J 49/0445* (2013.01); *H01J 49/0031* (2013.01); *H01J 49/105* (2013.01);
(Continued)

(58) Field of Classification Search
CPC .. H01J 49/0445; H01J 49/0031; H01J 49/105; H01J 49/145; H01J 49/161; H01J 49/165
(Continued)

(56) References Cited

U.S. PATENT DOCUMENTS 6,211,516 B1 4/2001 Syage et al.
6,906,322 B2 6/2005 Berggren et al.
(Continued)

FOREIGN PATENT DOCUMENTS

CN 209822593 U 12/2019
WO 2019234708 A1 12/2019
(Continued)

OTHER PUBLICATIONS

Lin, L. et al.: "Direct infusion mass spectrometry or liquid chromatography mass spectrometry for human metabonomics? A serum metabonomic study of kidney cancer." Analyst, 2010, 135, 2970-2978.

(Continued)

*Primary Examiner* — Michael Maskell
(74) *Attorney, Agent, or Firm* — Fox Rothschild LLP

(57) ABSTRACT

A system for the mass spectrometry analysis of an analyte includes a droplet ejection device, a spray head comprising a spray tip for ejecting the solvent as a spray, and a solvent delivery conduit for delivering solvent to the spray tip. The spray head includes a droplet inlet opening communicating with the surrounding atmosphere for receiving liquid droplets comprising the analyte. The droplet ejection device selectively ejects a liquid analyte droplet comprising the analyte through a surrounding atmosphere and the droplet inlet opening into a solvent flowing through the solvent delivery conduit. A method for the mass spectrometry analysis of an analyte is also disclosed.

36 Claims, 9 Drawing Sheets

(51) Int. Cl.
*H01J 49/16* (2006.01)
*H01J 49/14* (2006.01)
*H01J 49/10* (2006.01)

(52) U.S. Cl.
CPC ..... *H01J 49/145* (2013.01); *H01J 49/161* (2013.01); *H01J 49/165* (2013.01)

(58) Field of Classification Search
USPC ..... 250/281, 282, 288
See application file for complete search history.

(56) References Cited

U.S. PATENT DOCUMENTS

| | | | | |
|---|---|---|---|---|
| 7,488,953 | B2 | 2/2009 | Fischer et al. | |
| 8,513,599 | B2 | 8/2013 | Franzen et al. | |
| 9,165,751 | B1 | 10/2015 | Schleifer | |
| 9,805,921 | B2 * | 10/2017 | O'Brien | H01J 49/0463 |
| 9,852,896 | B2 | 12/2017 | Badu-Tawiah et al. | |
| 10,436,698 | B2 | 10/2019 | Bandura et al. | |
| 2007/0065946 | A1 * | 3/2007 | Reboud | G01N 33/5008 436/63 |
| 2008/0179511 | A1 * | 7/2008 | Chen | H01J 49/0445 250/288 |
| 2013/0164856 | A1 * | 6/2013 | Jebrail | B01L 3/502784 436/86 |
| 2014/0283627 | A1 * | 9/2014 | Hattingh | H01J 49/0454 73/864.81 |
| 2020/0191794 | A1 | 6/2020 | Cahill | |

FOREIGN PATENT DOCUMENTS

| | | | | |
|---|---|---|---|---|
| WO | 2019239332 | A1 | 12/2019 | |
| WO | WO-2019234708 | A1 * | 12/2019 | G01N 30/7233 |
| WO | WO-2019239332 | A1 * | 12/2019 | B01L 3/0268 |

OTHER PUBLICATIONS

Van Berkel et al.:"An open port sampling interface for liquid introduction atmospheric pressure ionization mass spectrometry." Rapid Commun. Mass Spectrom. 2015, 29, 1749-1756.

Van Berkel et. al:"Rapid sample classification using an open port sampling interface coupled with liquid introduction atmospheric pressure ionization mass spectrometry." Rapid Commun. Mass Spectrom 2017, 31, 281-291.

Van Berkel, G.J. et al. "Combined falling drop/open port sampling interface system for automated flow injection mass spectrometry." Anal. Chem. 2017, 89, 12578-12586.

Van Berkel, G. J. et al. "Immediate Drop on Demand Technology (I-DOT) coupled with mass spectrometry via an open port sampling interface." Bioanalysis 2017, 9, 1667-1679.

Häbe, T. et al.: "Ultrahigh-Throughput ESI-MS: Sampling Pushed to Six Samples per Second by Acoustic Ejection Mass Spectrometry." Anal. Chem. 2020, 92, 18, 12242-12249.

Cahill, J. F. et al.: "Rapid, Untargeted Chemical Profiling of Single Cells in Their Native Environment." Anal. Chem. 2019, 91, 6118-6126.

Spitzer, M. H.et al.: "Mass Cytometry: Single Cells, Many Features." Cell. 2016, 165, 780-791.

Pan, N. et al.: "The Single-Probe: A Miniaturized Multifunctional Device for Single Cell Mass Spectrometry Analysis." Anal. Chem. 2014, 86, 9376-9380).

U.S. Department of Energy, Rapid Droplet Introduction Interface.

Iyer, Kiran. Microdroplets: Chemistry, Applications and Manipulation Ionization Sources and Mass Spectrometry. Dissertation Dec. 2019.

Kempa et al.: "Coupling Droplet Microfluidics with Mass Spectrometry for Ultrahigh-Throughput Analysis of Complex Mixtures up to and above 30 Hz", Anal. Chem. 2020, 92, 12605-12612.

Steyer et al.: "High-Throughput Nanoelectrospray Ionization-Mass Spectrometry Analysis of Microfluidic Droplet Samples", Analytical Chemistry 2019 91 (10), 6645-6651.

Karas et al.: "Nano-electrospray ionization mass spectrometry: addressing analytical problems beyond routine", Fresenius J Anal Chem 366, p. 669-676 (2000).

J. Niklas et al.: "Drop-on-Demand Sample Introduction System Coupled with the Flowing Atmospheric-Pressure Afterglow for Direct Molecular Analysis of Complex Liquid Microvolume Samples", Anal. Chem. 84, 21, p. 9246-9252 (2012).

Bushey et al.: "Pulsed Nano-Electrospray Ionization: Characterization of Temporal Response and Implementation with a Flared Inlet Capillary", Instrumentation Science & Technology, 37:3, p. 257-273. (2009).

International Search Report mailed in PCT/US2021/051151 dated Dec. 27, 2021.

* cited by examiner

RAPID DROPLET INTRODUCTION INTERFACE (RDII) FOR MASS SPECTROMETRY

CROSS-REFERENCE TO RELATED APPLICATIONS

This application claims priority to U.S. 63/083,202 filed on Sep. 25, 2020, entitled "Rapid Droplet Introduction Interface (RDII) for Mass Spectrometry", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates to spectrometry, and more particularly to systems and methods for introducing an analyte into a spectrometer.

BACKGROUND OF THE INVENTION

Introduction of a real-life sample for chemical analysis by mass spectrometry (MS) can present certain challenges. In the case of atmospheric pressure ionization mass spectrometry (API-MS) with liquid introduction interfaces the sample must be in a solution that maximizes signal-to-noise (i.e. sensitivity) of the analyte of interest. In many cases, it requires vigorous sample processing which significantly extends the total analysis time. In the pharmaceutical and biochemical industries this additional time significantly increases the expense of the process. Industry participants can routinely analyze tens of thousands of samples in a day. Thus, even a small increase in sampling throughput can translate to significant monetary savings.

In the simplest form of liquid introduction for mass spectrometry the sample to be analyzed is pumped directly into the mass spectrometer in a process termed direct infusion (DI) MS (Lin, L.; Yu, Q.; Yan, X.; Hang, W; Zheng, J. Xing, J.; Huang, B. *Direct infusion mass spectrometry or liquid chromatography mass spectrometry for human metabonomics? A serum metabonomic study of kidney cancer. Analyst,* 2010, 135, 2970-2978). Typically, the liquid sample is contained in a syringe and a syringe pump is used to deliver a regular flow of liquid. Direct infusion is suitable for use with samples that are pure or that are simple mixtures composed of only a small number of constituents. The sample must also be free of contaminating factors that might interfere with mass spectrometric measurements, such as high levels of non-volatile salts/buffers and detergents. To satisfy these conditions, offline sample preparation almost always requires extensive dilution of the original sample.

Another method of liquid sample introduction is injection of the sample into a stream of MS appropriate liquid using a valve system. The most commonly used example is coupling high performance liquid chromatography with MS (HPLC-MS) (Lin, L.; Yu, Q.; Yan, X.; Hang, W; Zheng, J. Xing, J.; Huang, B. *Direct infusion mass spectrometry or liquid chromatography mass spectrometry for human metabonomics? A serum metabonomic study of kidney cancer. Analyst,* 2010, 135, 2970-2978). This method is used when the sample has many molecular components and/or when some molecules in the sample would interfere with the MS analysis, for example when inorganic salts and ionic buffers are present. In this case, an initial HPLC separation of the components is often essential. While this method enables separating individual sample components in time and space, thus allowing analytes from a mixture to be analyzed individually, analysis of a single sample (mixture) can take at least 1-2 min and as much as 1 hr.

To alleviate the issues with DI-MS and LC-MS, a vertically aligned, continuous flow, coaxial-tube sampling probe was introduced recently as a simple, versatile and self-cleaning open port sampling interface (OPSI) for liquid introduction API-MS (Van Berkel, G. J.; Kertesz, V. *An open port sampling interface for liquid introduction atmospheric pressure ionization mass spectrometry. Rapid Commun. Mass Spectrom.* 2015, 29, 1749-1756). This advance provides a simple sample introduction system with high throughput (seconds/sample), low material consumption, and high sensitivity. The OPSI has been used for manual liquid introduction (Van Berkel, G. J.; Kertesz, V. *Rapid sample classification using an open port sampling interface coupled with liquid introduction atmospheric pressure ionization mass spectrometry. Rapid Commun. Mass Spectrom.* 2017, 31, 281-291), automated liquid introduction by a gravitation-assisted falling droplet using a regular autosampler (PAL-DROP) (Van Berkel, G. J.; Kertesz, V.; Orcutt, M.; Bentley, A.; Glick, J.; Flarakos, J. *Combined falling drop/open port sampling interface system for automated flow injection mass spectrometry. Anal. Chem.* 2017, 89, 12578-12586), pneumatic liquid introduction (e.g., immediate droplet on demand technology, IDOT) (Van Berkel, G. J.; Kertesz, V.; Boeltz, H. *Immediate Droplet on Demand Technology (I-DOT) coupled with mass spectrometry via an open port sampling interface. Bioanalysis* 2017, 9, 1667-1679) and acoustically-assisted liquid introduction (e.g., ECHO-MS) (Habe, T.; Liu, C.; Covey, T. R.; Simon, R.; Reindl, W; Buttner, W; Winter, M.; Bischoff, D.; Luippold, A. H.; Runge. F. *Ultrahigh-Throughput ESI-MS: Sampling Pushed to Six Samples per Second by Acoustic Ejection Mass Spectrometry. Anal. Chem.* 2020, 92, 18, 12242-12249). In all cases, the minute amount of the sample introduced into the OPSI (1, 5 and 500 nL using ECHO, IDOT and PAL-DROP, respectively) ensured that interference from the matrix (inorganic salts, ionic buffers, and others) was suppressed or negligible due to the ~10-1000× dilution. However, this dilution reduces the sensitivity of the technique.

Beside analyzing sample droplets, metabolic analysis of single cells was demonstrated using a single cell printer (SCP) coupled to OPSI (Cahill, J. F.; Riba, J.; Kertesz, V. *Rapid, Untargeted Chemical Profiling of Single Cells in Their Native Environment. Anal. Chem.* 2019, 91, 6118-6126.) This method overcomes the trade-off that exists between comprehensive chemical coverage (the number of molecular species measured) and sampling throughput (the number of cells measured per second). Several single-cell analysis techniques use molecular tags to selectively analyze one-to-<50 individual molecules with high sampling throughput (>0.1 cell/s), but these methods require knowing the chemistry of interest beforehand. (Spitzer, M. H. and Nolan, G. P. *Mass Cytometry: Single Cells, Many Features. Cell.* 2016, 165, 780-791). Other techniques can comprehensively measure the chemistry of a single cell but lack sufficient throughput (typically <<0.1 cell/s) to enable statistical analysis of cell populations. (Pan, N., Rao, W, Kothapalli, N. R., Liu, R., Burgett, A. W. G., and Yang, Z. *The Single-Probe: A Miniaturized Multifunctional Device for Single Cell Mass Spectrometry Analysis. Anal. Chem.* 2014, 86, 9376-9380). These techniques usually require sample preparation protocols that may perturb the chemical profile of the cell before analysis, such as changing of cell media, introduction to vacuum, and addition of molecular tags. One limitation of the SCP-OPSI method is that the sensitivity of the technique is reduced because of dilution in the OPSI probe.

There is a need for a liquid analysis capability that can provide high sensitivity and high throughput chemical analysis of liquid droplets. The current state of the art (OPSI) dilutes samples significantly, resulting in reduced sensitivity. This analysis capability is highly desired in the biochemical, pharmaceutical, and medical research communities.

SUMMARY OF THE INVENTION

A system for the mass spectrometry analysis of an analyte includes a spray head comprising a spray tip for ejecting the solvent as a spray, and a solvent delivery conduit for delivering solvent to the spray tip. The spray head further includes a droplet inlet opening communicating with the surrounding atmosphere for receiving liquid drops comprising the analyte. A droplet ejection device is provided for selectively ejecting a liquid analyte droplet comprising the analyte through a surrounding atmosphere and the droplet inlet opening into a solvent flowing through the solvent delivery conduit. The system can further include a mass spectrometer having an analyte inlet configured to receive a spray of the solvent containing the analyte and performing mass spectrometry analysis on the spray of the solvent containing the analyte. The analyte droplet can include a cell. The surrounding atmosphere can be the ambient atmosphere.

The droplet ejection device can include at least one selected from a group including a syringe, a pipette device, a piezoelectric droplet ejection device, direct pressure induced droplet ejection device, and an acoustic force induced droplet ejection device.

The spray tip can be an electrospray tip. The electrospray tip can be electrically connected to a high voltage source. The spray tip can be a nanoelectrospray tip. The nanoelectrospray tip can be electrically connected to the high voltage source.

The system can further include an inductive coil positioned near the spray tip. The inductive coil can be electrically connected to a high voltage source. The system can include an atmospheric pressure chemical ionization spray tip. The system further can further include a high voltage electrode positioned in a path of the spray from the spray tip to a mass spectrometer inlet. The spray tip can be an atmospheric pressure photoionization spray tip, and can further include a photoionization light source.

The droplet inlet opening of the solvent delivery conduit can be a hole in the solvent delivery conduit. The droplet ejection device ejects droplets into the hole. The droplet inlet opening can be a beveled opening in the spray tip.

The system can further include a guidance apparatus for guiding the droplets into the droplet inlet opening. The guidance device can be an electromagnetic field source. The guidance device can be a guidance gas stream generator. The guidance device can be a chute. The guidance device can be a funnel.

The solvent supply conduit can include two spaced apart conduit segments. The space between the conduits defines the droplet inlet opening. The droplets can be transported from the droplet ejection device to the droplet inlet opening by the gravitational force.

The system can further include a processor for monitoring the movement of droplets from the droplet ejection device to the spray head and recording droplet data comprising the timing of the droplets. The droplet ejection device can include a droplet ejection control device, and the droplet ejection control device can be responsive to control signals from the processor to release a droplet.

A method for the mass spectrometry analysis of an analyte can include the step of providing a spray head comprising a spray tip for ejecting the solvent as a spray, and a solvent delivery conduit for delivering solvent to the spray tip. The spray head further includes a droplet inlet opening for receiving liquid analyte droplets comprising the analyte. A solvent is flowed through the spray head and generates a spray at the spray tip. A liquid analyte droplet is selectively ejected from a droplet ejection device. The liquid analyte droplet is collected in the droplet inlet opening of the spray head. The analyte is ionized and transmitted with solvent to the inlet of a mass spectrometer. The method can include detecting and analyzing the analyte using mass spectrometry. The droplet ejection device can be selected from a syringe, a pipette device, a piezoelectric droplet ejection device, direct pressure induced droplet ejection device, or acoustic force induced droplet ejection device. The surrounding atmosphere can be the ambient atmosphere.

The method can further include the step of guiding the liquid analyte droplet from the droplet ejection device to the droplet inlet opening. The guiding can be by at least one of an electromagnetic field, a gas stream, a chute, and a funnel. The method can further include the step of controlling the release of liquid analyte droplets with a control device. The method can include the step of operating the control device with a processor. The method can include the step of monitoring the movement of liquid analyte droplets from the droplet ejection device to the spray head and recording droplet data comprising the timing of the liquid analyte droplets. The method can include combining liquid analyte droplet data with mass spectrometer data.

The liquid analyte droplets can be transported from the droplet ejection device to the droplet inlet opening by the gravitational force. The liquid analyte droplet can contain a cell. The cell can be lysed by osmotic forces upon exposure to the collection solvent, thereby releasing molecular material. The solvent flow rate can be from 10 nl/min to 1 ml/min. The ionizing can include at least of electrospray ionization, atmospheric pressure chemical ionization, inductive ionization, and atmospheric pressure photoionization.

A method for the chemical analysis of an analyte includes the step of providing a spray head comprising a spray tip for ejecting the solvent as a spray, and a solvent delivery conduit for delivering solvent to the spray tip, the spray head further comprising a droplet inlet opening for receiving liquid analyte droplets comprising the analyte; flowing a solvent through the spray head and generating a spray at the spray tip; selectively ejecting a liquid analyte droplet from a droplet ejection device; collecting the liquid analyte droplet in the droplet inlet opening of the spray head; forming the analyte and solvent into a spray and transmitting the analyte and solvent spray to the inlet of a chemical analysis device. The chemical analysis device can be at least one of a mass spectrometry device, a spectrophotometric device, a fluorimetric device, and an amperometric detection device.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
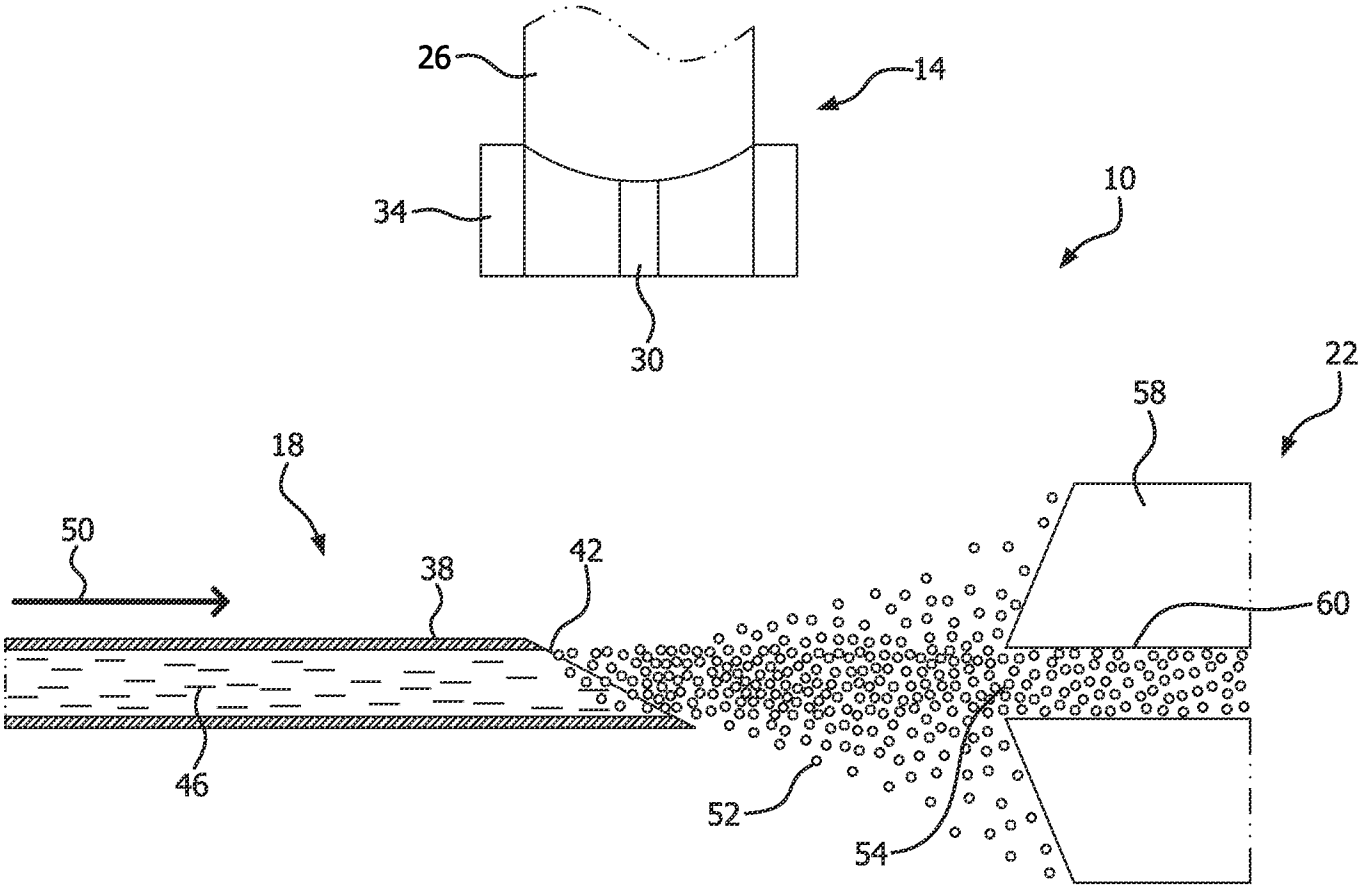
FIG. 1 is a schematic diagram of a system for the mass spectrometry analysis of an analyte, in a first mode of operation.

The system and methodology of the invention include the on-line analysis of small droplets containing analyte or single cells through the combination of droplet ejection with or without single cell isolation and capture into a continuously flowing open solvent stream (termed Rapid Droplet Introduction Interface (RDII)) mass spectrometry.

A droplet ejection device is used to selectively eject droplets with an analyte which can be a compound(s), single cell, or a cell suspension. The droplet ejection device should eject a droplet on demand or in a regulated fashion. The droplet(s) are then collected using an on-line, continuously flowing open solvent stream-mass spectrometry apparatus (RDII-MS). The droplet of sample analyte once exposed to the collection solvent of the RDII is diluted appropriately or lysed by osmotic forces releasing the molecular constituents of the cell. The packet of molecular material flowing with the solvent stream is subsequently ionized and detected using mass spectrometry. Molecular species can also be quantitatively analyzed using this technique with the addition of an internal standard to the liquid of the RDII.

A system for the mass spectrometry analysis of an analyte includes a droplet ejection device, a spray head comprising a spray tip for ejecting the solvent as a spray, and a solvent delivery conduit for delivering solvent to the spray tip. The spray head includes a droplet inlet opening communicating with the surrounding atmosphere for receiving liquid droplets comprising the analyte. The droplet ejection device selectively ejects a liquid analyte droplet comprising the analyte through a surrounding atmosphere and into the droplet inlet opening and into a solvent flowing through the solvent delivery conduit. The mass spectrometer can have an analyte inlet configured to receive a spray of the solvent containing the analyte and performing mass spectrometry or other chemical analysis on the spray of the solvent containing the analyte.

The system can be used with many different analytes that are suitable for mass spectrometry. The analyte droplet can contain an analyte compound(s), a cell or cell suspension. The cell can be lysed by osmotic forces upon exposure to the collection solvent, thereby releasing molecular material. The released molecular material can be for example lipids, amino acids, metabolites, dosed drugs, proteins, RNA, DNA. Other analytes are possible.

The droplet ejection device can be selected from many different kinds of droplet ejection devices. The droplet ejection device should be capable of controlling the release of the droplets in at least one of volume and frequency of the droplets. In one aspect, the droplet ejection device is controllable to release the droplets at the instruction of a processor. The droplet ejection device can be for example at least one selected from the group of a syringe, a pipette device, a piezoelectric droplet ejection device, direct pressure induced droplet ejection device, and an acoustic force induced droplet ejection device. Other droplet ejection devices are possible.

The spray tip takes solvent flowing through the solvent delivery conduit and forms the flowing solvent into an aerosol. This aerosol is directed into the chemical analysis device, such as a mass spectrometer. The spray tip can be an electrospray tip, and the electrospray tip can be electrically connected to a high voltage source. The electrospray tip can be a nanoelectrospray tip. The nanoelectrospray tip is electrically connected to a high voltage source. The system can include an inductive coil positioned near the spray tip, and the inductive coil can electrically connect to a high voltage source such that spray droplets pass through the inductive coil and are subjected to the electromagnetic field created by the inductive coil. The spray tip can be an atmospheric pressure chemical ionization spray tip. The atmospheric pressure chemical ionization system further includes a high voltage electrode positioned in a path of the spray from the spray tip to a mass spectrometer inlet. The spray tip can be an atmospheric pressure photoionization spray tip. The atmospheric pressure photoionization system can further include a photoionization light source directed so as to ionize the analyte. The ionization of the analyte can be performed by any suitable method. Other ionizing devices and processes are possible.

The droplet inlet opening opens in some fashion to the surrounding atmosphere such that droplets emanating from the droplet ejection device travel through the surrounding atmosphere and enter the solvent stream flowing through the solvent delivery conduit. The droplet inlet opening can take many different forms. The droplet inlet opening does not have to open directly to the surrounding atmosphere, so long as the droplet inlet opening operates at the pressure of the surrounding atmosphere and connects to a structure which connects to the surrounding atmosphere in a manner so as to receive the droplets from the droplet ejection device. The surrounding atmosphere can be ambient (room pressure) or can be at some other pressure surrounding the system such as under vacuum.

The solvent delivery conduit can have an opening of the solvent delivery conduit, and the droplet ejection device ejects droplets into this opening that functions as the droplet inlet opening. The droplet inlet opening can be a beveled opening in the spray tip. The droplet inlet opening can be formed by another conduit leading into the solvent delivery conduit, so long as the other conduit is open to the surrounding atmosphere.

The system can further include guidance apparatus for guiding the droplets into the droplet inlet opening. The guidance device can be a guidance gas stream generator. The guidance device can be a chute. The guidance device can be a funnel. The guidance device in the case of a charged solvent or analyte in the droplets emanating from the droplet ejection device can be an electromagnetic field source. The solvent supply conduit can include two spaced apart conduit segments. The space between the conduits defines the droplet inlet opening. The droplets can be transported from the droplet ejection device to the droplet inlet opening by the gravitational force.

The system can further include a processor for monitoring the movement of droplets from the droplet ejection device to the spray head and recording droplet data comprising the timing of the droplets. The droplet ejection device can have a droplet ejection control device. The droplet ejection control device can be responsive to control signals from the processor to release a droplet. The droplet ejection control device can be a valve or similarly acting structure which can be used to control the ejection of droplets from the droplet ejection device.

A method for the mass spectrometry analysis of an analyte includes the step of providing a spray head comprising a spray tip for ejecting the solvent as a spray, and a solvent delivery conduit for delivering solvent to the spray tip. The spray head further includes a droplet inlet opening for receiving liquid analyte droplets comprising the analyte from the surrounding atmosphere. A solvent is flowed through the spray head and the spray tip generates a spray that is directed to a mass spectrometer inlet. A liquid analyte droplet is selectively ejected from a droplet ejection device through the surrounding atmosphere, and the liquid analyte droplet is collected in the droplet inlet opening of the spray head. The analyte is ionized, and the solvent and the ionized analyte are transmitted to the inlet of a mass spectrometer. The analyte is detected and analyzed using mass spectrometry.

The method can include the step of guiding the liquid analyte droplet from the droplet ejection device to the droplet inlet opening. The guiding can be by at least one selected from the group of a gas stream, a chute, a funnel, and an electromagnetic field.

The method can include the step of controlling the release of liquid analyte droplets with a control device. The control device can be operated with a processor. The movement of liquid analyte droplets from the droplet ejection device to the spray head can be monitored. Droplet data comprising the timing of the liquid analyte droplets can be recorded. The liquid analyte droplet data can be combined with mass spectrometer data.

The solvent flow rate can vary. The solvent flow rate can be from 10 nl/min to 1 ml/min. The solvent flow rate can be 10, 20, 30, 40, 50, 60, 70, 80, 90, 100, 125, 150, 175, 200, 225, 250, 275, 300, 325, 350, 375, 400, 425, 450, 475, 500, 525, 550, 575, 600, 625, 650, 675, 700, 725, 750, 775, 800, 825, 850, 875, 900, 925, 950, 975 and 1000 nl/min, and can be within a range of any high value and low value selected from these values.

In general, a droplet-on-demand droplet ejection system is aligned such that the ejected droplets are collected in the droplet inlet opening. Proper solvent in the solvent delivery conduit and high voltage applied allows optimal spray conditions and lysis in case of single cells for the consecutive online mass spectrometer analysis.

To illustrate the analytical utility of this coupling, a commercially available single cell droplet ejection system (Single-cell Printer™, Cytena GmbH, Freiburg, Germany) was used as an external actuator to eject droplets from a cartridge filled with ~50 μL of aqueous solution of 5 mM drug propranolol. 10 droplets (~50 μm diameter each) were deposited into the beveled end of a 21 G×3⅛" hypodermic needle with a 15° beveled angle (Rose GmbH, Tier, Germany), acting as the spray head. The spray head was then manually transferred in front of an ion-trap mass spectrometry system (LTQ XL, Thermo, San Jose, USA) and provided 100/0.1 methanol/formic acid solvent at a 5 μL/min flow rate through the needle. A high voltage (2.8 kV) was applied to it to create nanoelectrospray. Extracted ion chronogram of propranolol demonstrated appropriate signal from the deposited drug solution droplets. The viability was tested in an offline manner, but can work in an online manner. The throughput of the system was about 3-5 s/sample (droplet with or without a single cell), and could be further accelerated using multichannel methods with multiple probes capturing the droplets sequentially. A sampling throughput of 1 sample/s is achievable.

Chemical analysis of liquids or single cells often requires choosing between having sensitivity, comprehensive chemical coverage or having high sampling throughput. The benefits of the inventive system are that it provides a way to quantitatively measure the chemistry of system-generated liquid droplets or single cells in an untargeted or targeted manner with high sampling throughput and with high sensitivity. Further, no sample preparation steps are needed before analysis which significantly reduces experimental complexity and allows for the measure of cells in their native state. The inventive system is useful in many applications, such as the on-line measurement of the chemistry of single droplets generated with multiple droplet-on-demand sample introduction systems (IDOT, ECHO, SCP) with minimized sample dilution with mass spectrometric detection. The system can be used for the on-line measurement of the chemistry of single cells such as algae, bacteria, and mammalian cells, and in suspension using SCP with mass spectrometric detection. The invention can also be used with droplet ejection coupled to liquid capture for consecutive mass spectrometric, spectrophotometric, fluorimetric, and amperometric detection, as well as other forms of detection.

There is shown in FIG. 1 a system 10 for mass spectrometry analysis. The system 10 includes a droplet ejection device 14, a spray head 18, and a mass spectrometer 22. The droplet ejection device 14 includes a container 26 and an opening 30 for ejection of the analyte. The control device 34 can be associated with the droplet ejection device 14 to control the ejection of droplets from the opening 30.

The spray head 18 includes a solvent delivery conduit 38 and a spray tip 42. The solvent delivery conduit 38 includes open interior for the transport of solvent 46 in the direction shown by arrow 50. The spray tip 42 comprises a droplet inlet opening communicating with the surrounding atmosphere for receiving liquid droplets comprising the analyte. The mass spectrometer 22 includes a mass spectrometer inlet assembly 58 with an inlet opening 60. Solvent 46 flowing through the conduit 38 is formed into a spray 52 at the spray tip 42. Particles 54 of the spray 52 enter the inlet opening 60 of the mass spectrometer 22.

Figure 2:
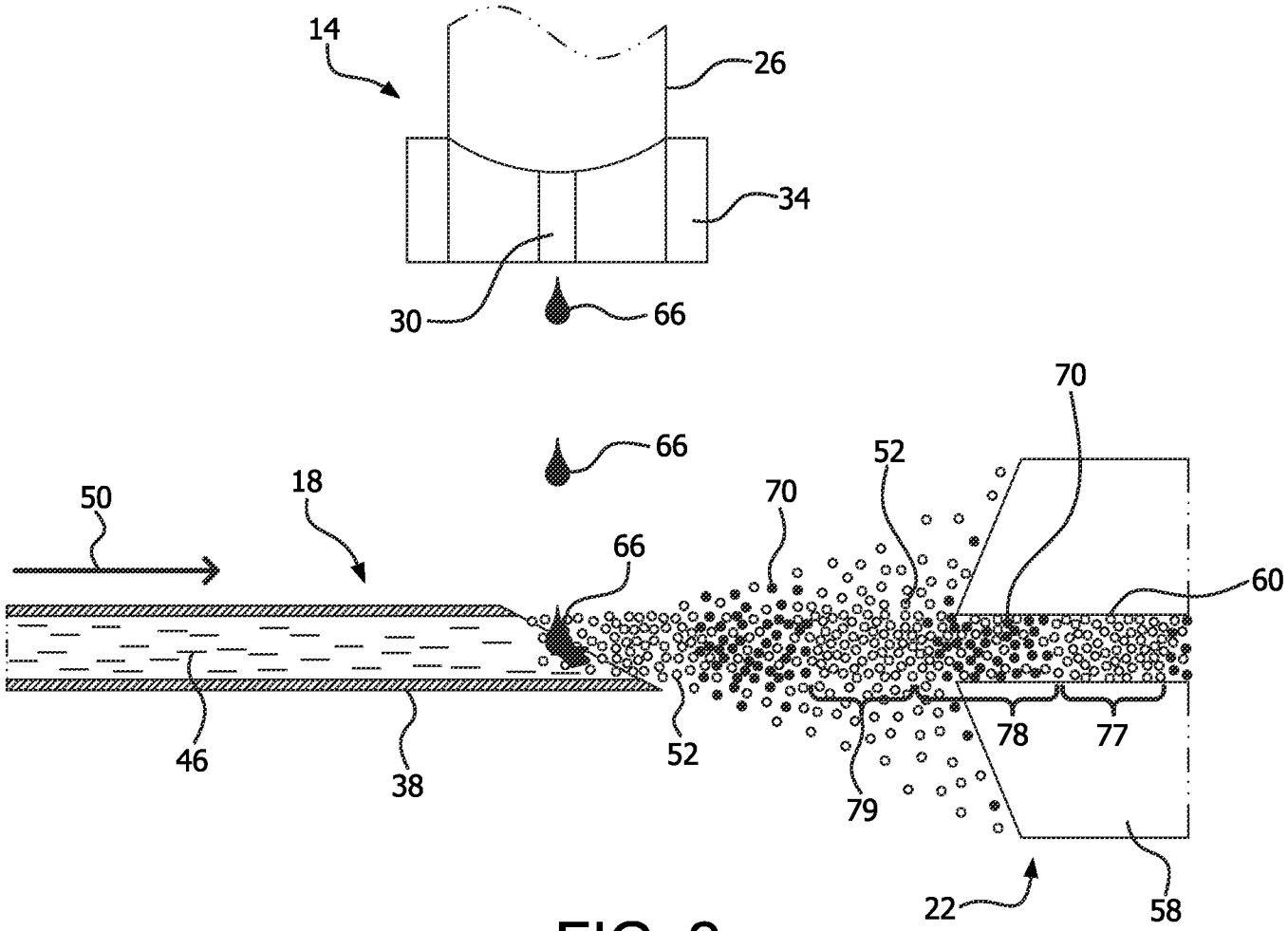
FIG. 2 is a schematic diagram of a system for the mass spectrometry analysis of an analyte, in a second mode of operation.

In operation, as shown in FIG. 2, droplets 66 are released by the droplet ejection device 14. The analyte droplets are diluted in the solvent and formed into spray particles 70 along with the solvent particles 52. Some of the analyte particles 70 enter the inlet opening 60 of the mass spectrometer 22 together with solvent spray particles 52. The analyte particles 70 and solvent particles 52 enter the mass spectrometer inlet opening 60 as a plug generally defined by area 78. The plug 78 is an area where there is a concentrated mixture of analyte particles 70 with solvent particles 52. The stream of solvent particles 52 immediately in front of or downstream of the plug 78, indicated by area 77, and in back of or upstream of the plug 78, indicated by area 79, are substantially devoid of analyte particles.

Figure 3:
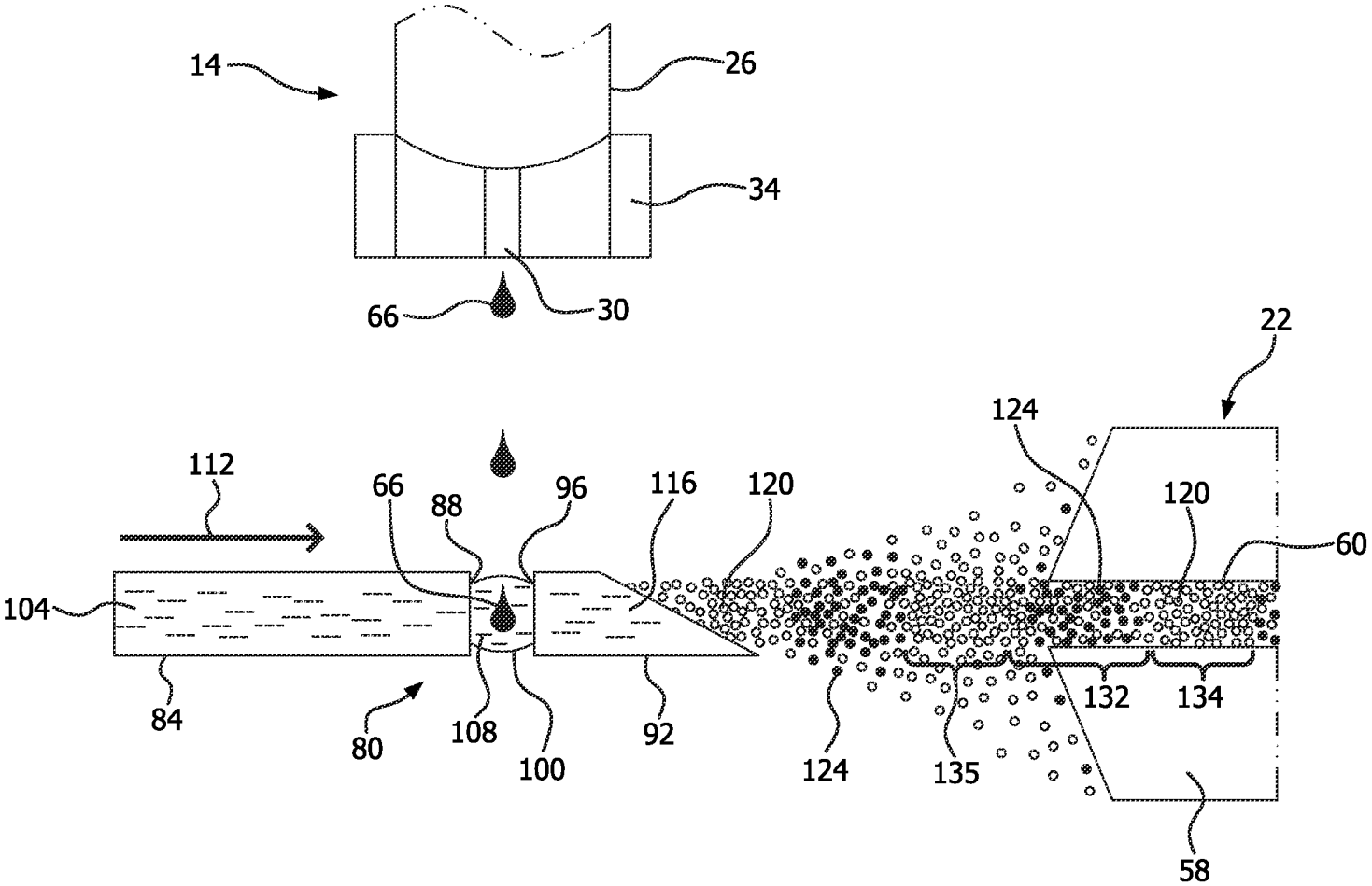
FIG. 3 is a schematic diagram of a first alternative system for the mass spectrometry analysis of an analyte.

There is shown in FIG. 3 an alternative embodiment of a spray head 80 having a solvent delivery conduit 84 with an open end 88. A spray tip 92 has an open end 96. The open end 88 of the solvent delivery conduit 84 is spaced from the open end 96 of the spray tip 92 defining an opening 100 which serves as the droplet inlet opening. Solvent 104 travels through the solvent delivery conduit 84 in the direction of arrow 112 and reaches the droplet inlet opening 100 such that a portion 108 of the solvent stream 104 is exposed to the surrounding atmosphere. The analyte droplets 66 enter the exposed solvent portion 108 of the flowing solvent stream 104.

The spray tip 92 has a beveled end 116 which generates a spray 120 of solvent 104. Analyte spray particles 124 are generated as the droplets 66 are also turned into a spray. Analyte spray particles 124 enter the inlet opening 60 of the mass spectrometer 22 and are confined as a plug 132. A portion 134 of the solvent stream immediately downstream and a portion 135 immediately upstream are substantially devoid of analyte spray particles 124.

Figure 4:
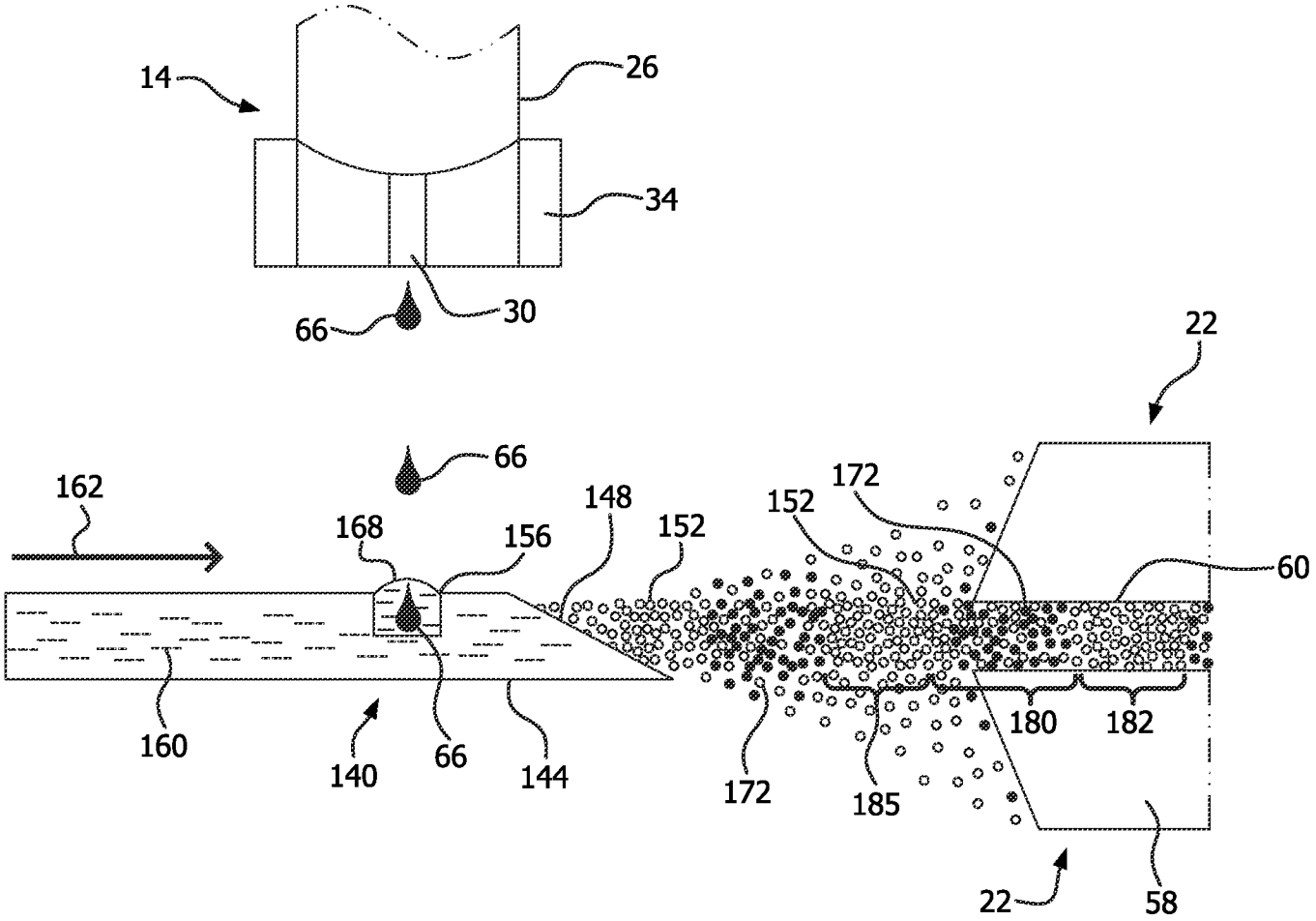
FIG. 4 is a schematic diagram of a second alternative system for the mass spectrometry analysis of an analyte.

There is shown in FIG. 4 an alternative embodiment a spray head 140. A solvent delivery conduit 144 has a spray tip with a beveled end 148. A solvent stream 160 flows through the solvent delivery conduit 144 in the direction of arrow 162. An opening 156 in the solvent delivery conduit 144 exposes a portion 168 of the solvent stream 160 to the surrounding atmosphere. Droplets 66 from the droplet ejection device 14 enter the opening 156 and thereby solvent stream 160. The solvent stream 160 at the spray tip 148 is formed into a spray 152. Analyte spray particles 172 are also generated. Analyte particles 172 enter the inlet opening 60 of the mass spectrometer 22 as a plug 180. A portion 182 of the solvent stream immediately downstream of the plug 180 and a portion 185 immediately upstream of the plug 180 are substantially devoid of analyte particles.

Figure 5:
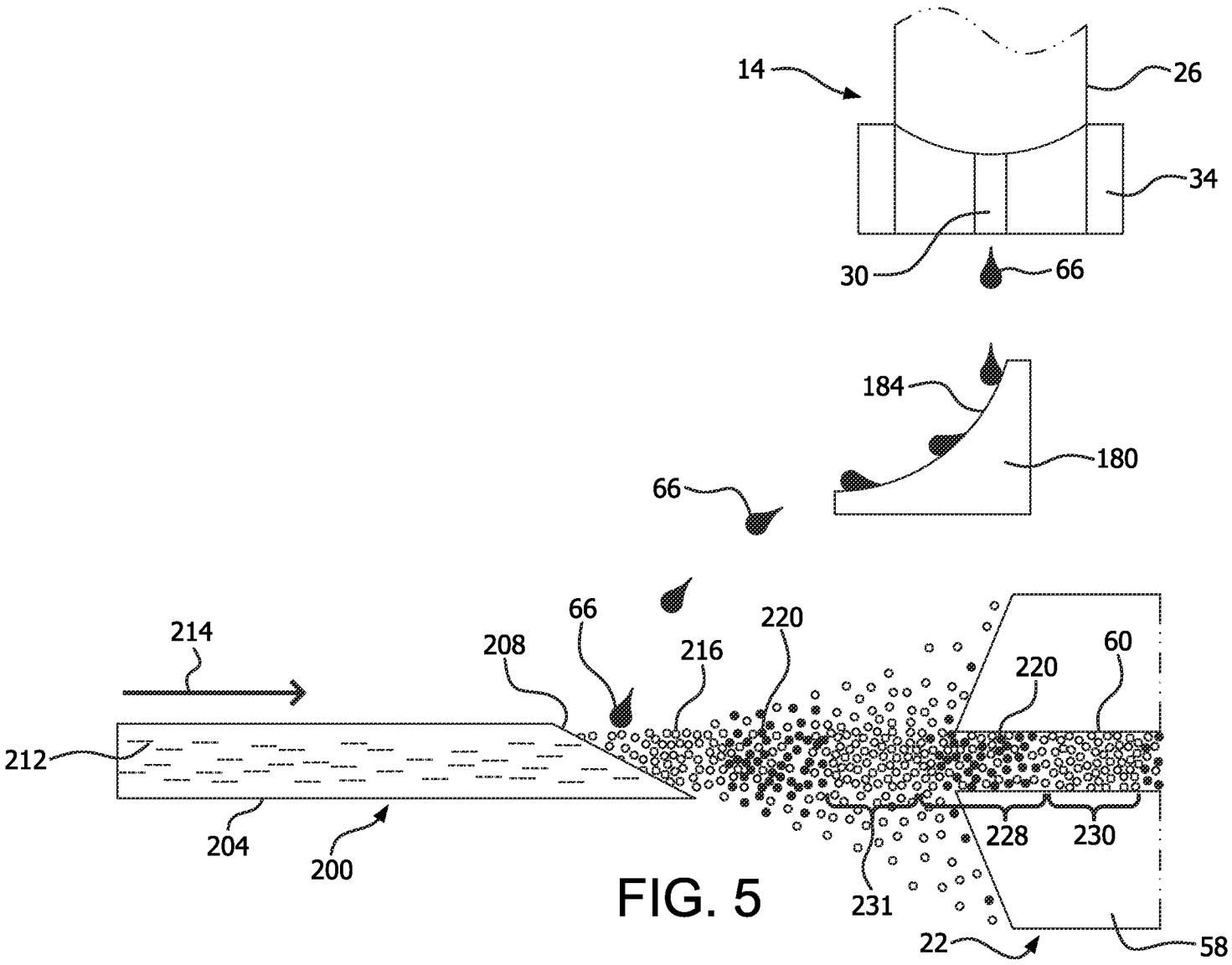
FIG. 5 is a schematic diagram of a third alternative system for the mass spectrometry analysis of an analyte.

There is shown in FIG. 5 an alternative embodiment of a spray head 200 with a solvent delivery conduit 204 and a spray tip in the form of a beveled end 208. A solvent stream 212 flows through the solvent delivery conduit 204 in the direction of arrow 214 and is turned into a spray 216. Droplets 66 from the droplet ejection device 14 are released and encounter a chute 180 having curved surface 184 which guides analyte droplets 66 to the beveled end 208. The analyte droplets 66 are turned into analyte spray particles 220 and travel with the solvent spray 216 to the mass spectrometer 22. Analyte particles 220 enter the inlet opening 60 the mass spectrometer 22 as a plug 228 mixed with solvent particles 216. A portion 230 of the solvent particle stream immediately downstream and a portion 231 immediately upstream of the plug 228 are substantially devoid of analyte spray particles 220.

Figure 6:
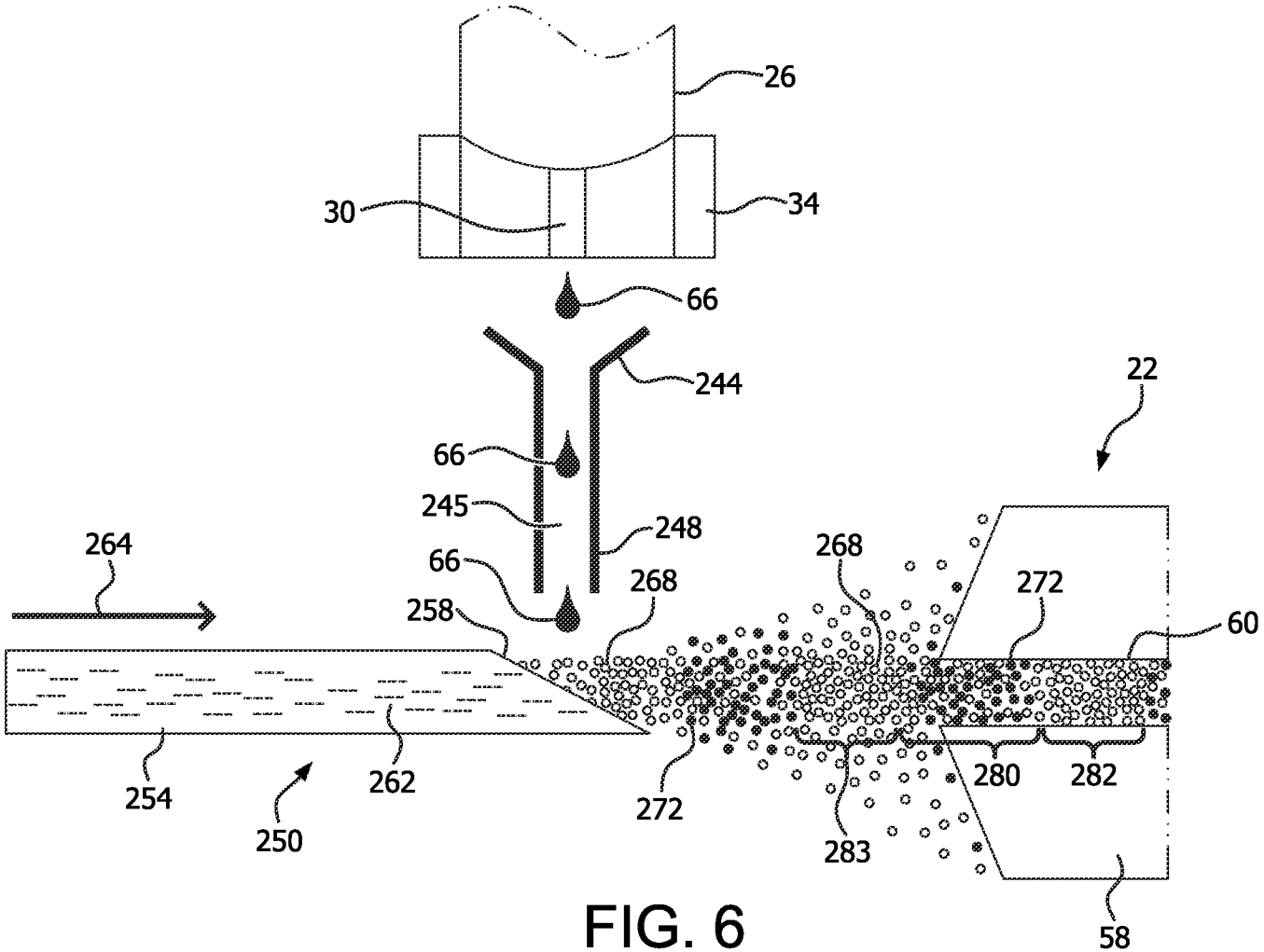
FIG. 6 is a schematic diagram of a fourth alternative system for the mass spectrometry analysis of an analyte.

There is shown in FIG. 6 an alternative embodiment of a spray head 250 with a solvent delivery conduit 254 and a spray tip comprising a beveled end 258. Solvent stream 262 moves through the solvent delivery 254 in the direction of arrow 264. A funnel 244 receives analyte droplets 66 and directs the droplets through open interior 245 of funnel body 248 into a solvent spray 268 generated at the spray tip 258. The analyte droplets 66 are turned into analyte spray particles 272 by the spray tip 258 and the solvent particles 268 and analyte particles 272 travel to the inlet opening 60 of the mass spectrometer 22. Analyte spray particles 272 with the solvent spray particles 268 enter the inlet opening 60 as a plug 280. A portion 282 of the solvent spray particles 268 immediately downstream and a portion 283 immediately upstream of the plug 280 are substantially devoid of analyte particles.

Figure 7:
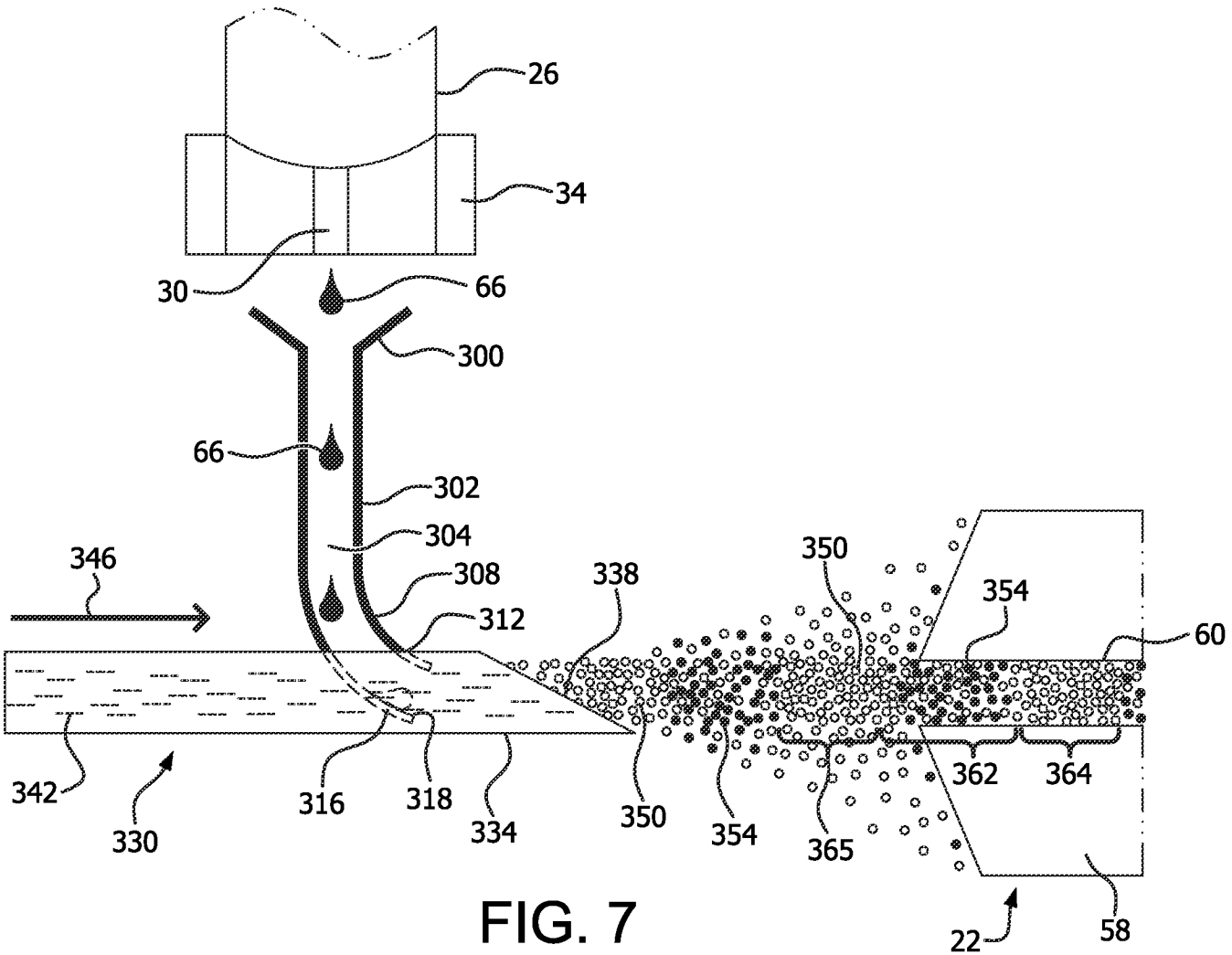
FIG. 7 is a schematic diagram of a fifth alternative system for the mass spectrometry analysis of an analyte.

There is shown in FIG. 7 an alternative embodiment of the spray head 330 having a solvent delivery conduit 334 and a spray tip comprising a beveled end 338. A solvent stream 342 travels through the solvent delivery conduit 334 in the direction shown by arrow 346. A funnel 300 communicates with a funnel body 302 with an open interior 304. The funnel body 300 has a curved portion 308 and enters the solvent delivery conduit 334 at an opening 312. A portion 316 of the funnel body 302 is within the solvent delivery conduit 334 such that droplets 66 of the analyte are directed through the funnel 300 and into the flowing solvent stream 342. An open end 318 of the funnel 300 can be directed so as to release the droplets 66 in the direction of the solvent stream 342 indicated by arrow 346. The solvent stream 342 is turned into a spray of solvent spray particles 350 by the spray tip 338. The solvent droplets 66 will be also be turned into a spray of analyte spray particles 354. The solvent spray particles 350 and analyte spray particles 354 will travel to the inlet opening 60 of the mass spectrometer 22. Analyte spray particles 354 mixed with solvent spray particles 350 will enter the inlet opening 60 as a plug 362. A portion 364 of the solvent spray particles 350 immediately downstream and a portion 365 immediately upstream of the plug 362 will be substantially devoid of analyte particles.

Figure 8A:
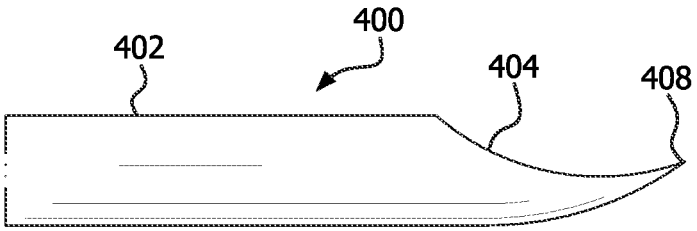
FIG. 8A is a side elevation of a spray head.
Figure 8B:
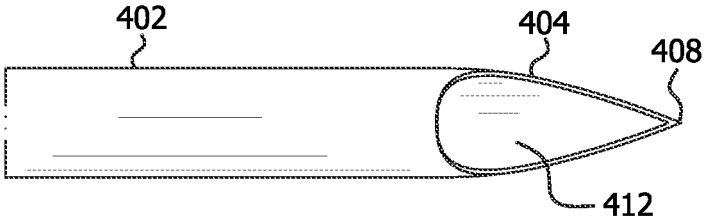
FIG. 8B is a plan view of the spray head of FIG. 8A.
Figure 8C:
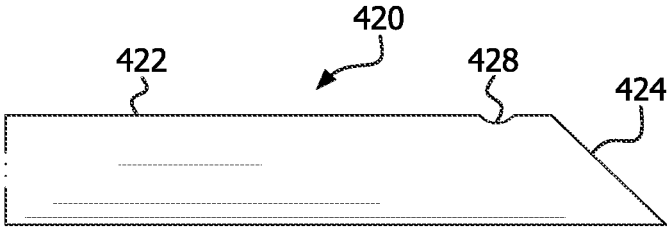
FIG. 8C is a side elevation of an alternative spray head.
Figure 8D:
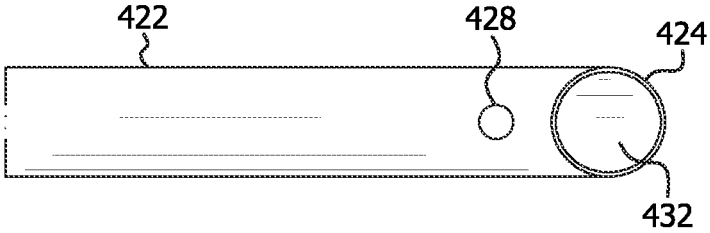
FIG. 8D is a plan view of the spray head of FIG. 8C.
Figure 8E:
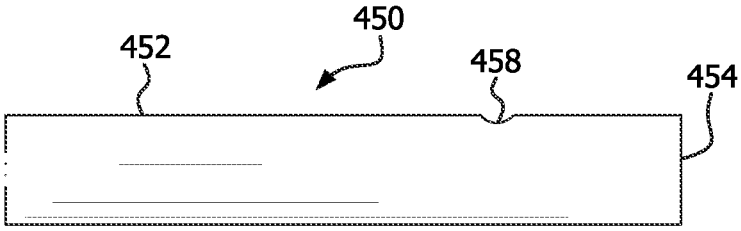
FIG. 8E is a side elevation of another alternative spray head.
Figure 8F:
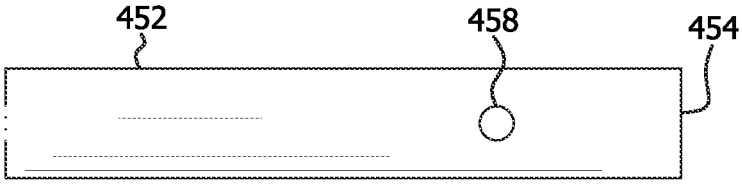
FIG. 8F is a plan view of the spray head of FIG. 8E.

There is shown in FIGS. 8A-8F different embodiments of a spray head according to the invention. There is shown in FIGS. 8A-B a spray head 400 with a solvent delivery conduit 402 and a spray tip comprising a curved, beveled end 404 culminating in a point 408. The spray head 400 has an open interior 412. There is shown in FIGS. 8C-8D a spray head 420 having a solvent delivery conduit 422 and a spray tip comprising a beveled end 424. A droplet inlet opening 428 is provided and communicates with an open interior 432. There is shown in FIGS. 8E-8F a spray head 450 with a solvent delivery conduit 452. The spray head 450 has a straight open end 454 and a droplet inlet opening 458. Other spray head designs are possible.

Figure 9:
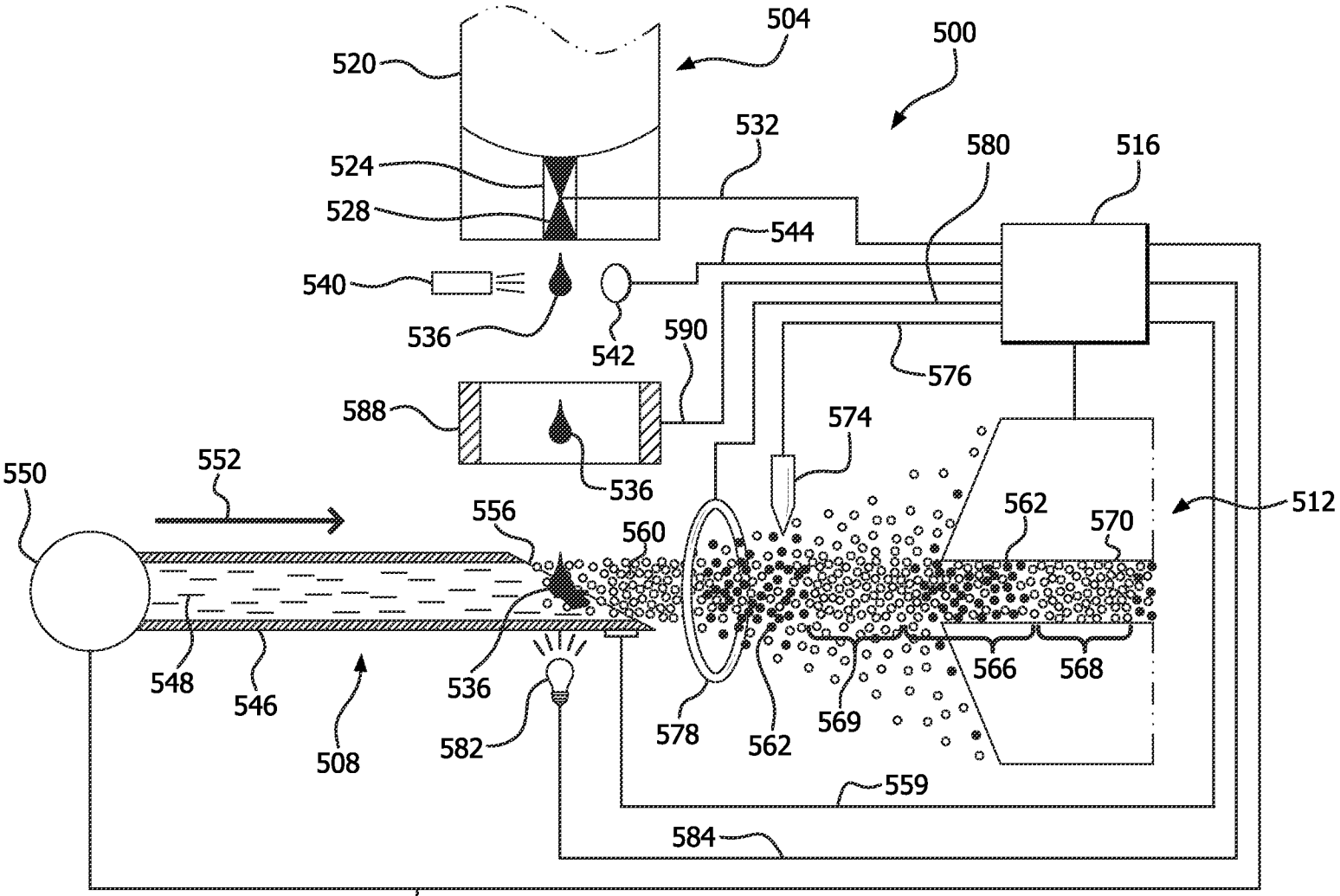
FIG. 9 is a schematic diagram of a system for the mass spectrometry analysis of an analyte, with droplet control devices and alternative analyte ionizing devices.

There is shown in FIG. 9 an example system 500 which shows several alternative embodiments of the invention. The system 500 includes droplet ejection device 504, a spray head 508, and a mass spectrometer 512. A processor 516 can be provided to control operation of the system 500. The droplet ejection device 504 includes an analyte container 520, a droplet ejection opening 524, and possibly a droplet ejection valve 528. The droplet ejection valve 528 can be controlled by the processor 516 through a control line 532. Sensors can be provided to monitor the injection of droplets 536. Such a sensor can be a light source 540 and a detector 542 which are connected to the processor through a control line 544.

The spray head 508 can include a solvent delivery conduit 546 which has flowing stream of solvent 548 from a suitable solvent source 550, and flows in the direction of arrow 552. The flow of solvent 548 from source 550 can be controlled by control line 558 communicating with the processor 516. The spray head 508 includes a spray tip including a beveled end 556 which generates a spray of solvent spray particles 560. The analyte droplets 536 are also converted to spray such as analyte spray particles 562. The solvent spray particles 560 and analyte spray particles 562 are concentrated into a plug 566 which enters an inlet opening 570 of the mass spectrometer 512. A portion of the solvent stream downstream of the plug 566 as indicated by area 568 and upstream from the plug 566 as indicated by area 569 are substantially devoid of analyte spray particles 562.

The manner in which the analyte droplets 536 and subsequently the analyte spray particles 562 are ionized can vary. An electrode pin 574 can for example be positioned near to solvent spray particles 560 and analyte spray particles 562 with high voltage to create a corona discharge creating gas-phase ions which ionize analyte particles. The electrode 574 can communicate with the processor 516 through control line 576. An inductive ring 578 can communicate with the processor 516 through a control line 580. The solvent spray particles 560 and analyte spray particles 562 can be directed through the inductive ring 578, whereupon the analyte particles will be ionized in the inductive field. A photoradiation source 582 can communicate with the processor 516 through control line 584. The photoradiation source will direct radiation at the analyte particles and will directly ionize analyte particles or will ionize dopants which ionize the analyte particles. The solvent delivery conduit 546 can communicate with the processor 516 through control line 559. The solvent delivery conduit 546 can act as an electrode with high voltage controlled by the processor 516 to ionize solvent spray particles 560 and analyte spray particles 562 by electrospray or nanoelectrospray.

The droplet guidance apparatus 588 can be provided and connected to the processor 516 by a control line 590. The droplet guidance apparatus 588 can be pneumatic, electromagnetic or other or a positionable funnel or chute that can be controlled by the processor 516 through suitable actuators.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A system for the mass spectrometry analysis of an analyte, the system comprising:

a spray head comprising a spray tip for ejecting a solvent as a spray, and a solvent delivery conduit for delivering solvent to the spray tip, the spray head further comprising a droplet inlet opening communicating with the surrounding atmosphere for receiving liquid drops comprising the analyte; and, a droplet ejection device for selectively ejecting a liquid analyte droplet comprising the analyte through a surrounding atmosphere and the droplet inlet opening into a solvent flowing through the spray tip of the solvent delivery conduit.

2. The system of claim 1, further comprising a mass spectrometer having an analyte inlet configured to receive a spray of the solvent containing the analyte and performing mass spectrometry analysis on the spray of the solvent containing the analyte.

3. The system of claim 1, wherein the analyte droplet comprises a cell.

4. The system of claim 1, wherein the droplet ejection device comprises at least one selected from the group consisting of a syringe, a pipette device, a piezoelectric droplet ejection device, direct pressure induced droplet ejection device, and an acoustic force induced droplet ejection device.

5. The system of claim 1, wherein the spray tip is an electrospray tip, and the electrospray tip is electrically connected to a high voltage source.

6. The system of claim 5, wherein the spray tip is a nanoelectrospray tip, and the nanoelectrospray tip is electrically connected to the high voltage source.

7. The system of claim 1, wherein the system further comprises an inductive coil positioned near the spray tip, and the inductive coil is electrically connected to a high voltage source.

8. The system of claim 1, wherein the spray tip is an atmospheric pressure chemical ionization spray tip, and the system further comprises a high voltage electrode positioned in a path of the spray from the spray tip to a mass spectrometer inlet.

9. The system of claim 1, wherein the spray tip is an atmospheric pressure photoionization spray tip, and further comprising a photoionization light source.

10. The system of claim 1, wherein the droplet inlet opening is a beveled opening in the spray tip.

11. The system of claim 1, further comprising guidance device for guiding the droplets into the droplet inlet opening.

12. The system of claim 11, wherein the guidance device is an electromagnetic field source.

13. The system of claim 11, wherein the guidance device is a guidance gas stream generator.

14. The system of claim 11, wherein the guidance device is a chute.

15. The system of claim 11, wherein the guidance device is a funnel.

16. The system of claim 1, wherein the solvent supply conduit comprises two spaced apart conduit segments, the space between the conduits defining the droplet inlet opening.

17. The system of claim 1, wherein the droplets are transported from the droplet ejection device to the droplet inlet opening by the gravitational force.

18. The system of claim 1, further comprising a processor for monitoring the movement of droplets from the droplet ejection device to the spray head and recording droplet data comprising the timing of the droplets.

19. The system of claim 1, wherein the droplet ejection device comprises a droplet ejection control device, the droplet ejection control device being responsive to control signals from a processor to release a droplet.

20. The system of claim 1, wherein the surrounding atmosphere is the ambient atmosphere.

21. A method for the mass spectrometry analysis of an analyte, the method comprising the steps of:

providing a spray head comprising a spray tip for ejecting a solvent as a spray, and a solvent delivery conduit for delivering solvent to the spray tip, the spray tip of the spray head further comprising a droplet inlet opening for receiving liquid analyte droplets comprising the analyte;

flowing a solvent through the spray head and generating a spray at the spray tip;

selectively ejecting a liquid analyte droplet from a droplet ejection device;

collecting the liquid analyte droplet in the droplet inlet opening of the spray head;

ionizing the analyte and transmitting the ionized analyte and solvent to the inlet of a mass spectrometer; and detecting and analyzing the analyte using mass spectrometry.

22. The method of claim 21, wherein the droplet ejection device is at least one selected from the group consisting of a syringe, a pipette device, a piezoelectric droplet ejection device, direct pressure induced droplet ejection device, or acoustic force induced droplet ejection device.

23. The method of claim 21, further comprising the step of guiding the liquid analyte droplet from the droplet ejection device to the droplet inlet opening.

24. The method of claim 23, wherein the guiding is by at least one selected from the group consisting of an electromagnetic field, a gas stream, a chute, and a funnel.

25. The method of claim 21, further comprising the step of controlling the release of liquid analyte droplets with a control device.

26. The method of claim 25, further comprising the step of operating the control device with a processor.

27. The method of claim 26, further comprising the step of monitoring the movement of liquid analyte droplets from the droplet ejection device to the spray head and recording droplet data comprising the timing of the liquid analyte droplets.

28. The method of claim 27, further comprising the step of combining liquid analyte droplet data with mass spectrometer data.

29. The method of claim 21, wherein the liquid analyte droplets are transported from the droplet ejection device to the droplet inlet opening by the gravitational force.

30. The method of claim 21, wherein the liquid analyte droplet contains a cell.

31. The method of claim 30, wherein the cell is lysed by osmotic forces upon exposure to the collection solvent, thereby releasing molecular material.

32. The method of claim 21, wherein the surrounding atmosphere is the ambient atmosphere.

33. The method of claim 21, wherein the solvent flow rate is from 10 nl/min to 1 ml/min.

34. The method of claim 21, wherein the ionizing comprises at least one selected from the group consisting of electrospray ionization, atmospheric pressure chemical ionization, inductive ionization, and atmospheric pressure photoionization.

35. A method for the chemical analysis of an analyte, the method comprising the steps of:

providing a spray head comprising a spray tip for ejecting a solvent as a spray, and a solvent delivery conduit for delivering solvent to the spray tip, the spray head further comprising a droplet inlet opening at the spray tip for receiving liquid analyte droplets comprising the analyte;

flowing a solvent through the spray head and generating a spray at the spray tip;

selectively ejecting a liquid analyte droplet from a droplet ejection device;

collecting the liquid analyte droplet in the droplet inlet opening of the spray head;

forming the analyte and solvent into a spray and transmitting the analyte and solvent spray to the inlet of a chemical analysis device.

36. The method of claim 35, wherein the chemical analysis device comprises at least one selected from the group consisting of mass spectrometry device, spectrophotometric device, fluorimetric device, and amperometric detection device.

* * * * *